US007568700B2

(12) United States Patent
Bentley

(10) Patent No.: US 7,568,700 B2
(45) Date of Patent: Aug. 4, 2009

(54) FITNESS BINGO

(76) Inventor: Matthew C. Bentley, 7585 Carlton Dr., Ypsilanti, MI (US) 48197

( * ) Notice: Subject to any disclaimer, the term of this patent is extended or adjusted under 35 U.S.C. 154(b) by 146 days.

(21) Appl. No.: 11/390,016

(22) Filed: Mar. 27, 2006

(65) Prior Publication Data

US 2007/0222149 A1 Sep. 27, 2007

(51) Int. Cl.
*A63F 3/00* (2006.01)

(52) U.S. Cl. ..... 273/269; 463/19

(58) Field of Classification Search ..... 273/269; D21/377; 463/19

See application file for complete search history.

(56) References Cited

U.S. PATENT DOCUMENTS

| | | | | | |
|---|---|---|---|---|---|
| 1,655,380 | A | | 1/1928 | Parker | |
| D132,993 | S | | 5/1942 | Lowe | |
| 2,484,143 | A | | 10/1949 | Arnold | |
| 2,743,108 | A | | 4/1956 | Sanders | |
| 2,769,640 | A | * | 11/1956 | Elder | 273/269 |
| 3,197,891 | A | | 8/1965 | Pierce | |
| 3,464,124 | A | * | 9/1969 | Lynd | 434/170 |
| 3,495,700 | A | | 2/1970 | Chandos | |
| 3,534,963 | A | | 10/1970 | Weimer | |
| 3,665,618 | A | | 5/1972 | Hahn | |
| 3,967,825 | A | | 7/1976 | Anania, Sr. | |
| 3,975,021 | A | | 8/1976 | Brown | |
| 4,015,850 | A | | 4/1977 | Russell | |
| 4,021,937 | A | * | 5/1977 | Kravitz | 434/167 |
| 4,046,382 | A | | 9/1977 | Ratzkoff | |
| 4,165,878 | A | | 8/1979 | Frain | |
| 4,169,601 | A | | 10/1979 | Frischmann et al. | |
| 4,285,520 | A | | 8/1981 | Small | |
| 4,509,759 | A | | 4/1985 | Small | |
| 4,619,457 | A | | 10/1986 | Small | |
| 4,711,454 | A | | 12/1987 | Small | |
| 4,877,253 | A | | 10/1989 | Arens | |
| 4,883,636 | A | | 11/1989 | Fantle, Jr. | |
| 5,139,270 | A | * | 8/1992 | Gernhofer | 273/269 |
| D341,854 | S | | 11/1993 | Mobley | |
| D356,834 | S | | 3/1995 | Steffensen | |
| 5,449,179 | A | * | 9/1995 | Hefferan | 273/269 |
| 5,458,338 | A | | 10/1995 | Beardsley | |
| D381,696 | S | | 7/1997 | Stuart | |
| 5,657,991 | A | | 8/1997 | Camarato | |
| 5,743,740 | A | * | 4/1998 | Visser et al. | 434/128 |
| D407,125 | S | | 3/1999 | Hopkins | |
| 5,957,457 | A | * | 9/1999 | Shaw | 273/269 |
| 6,220,596 | B1 | | 4/2001 | Horan | |
| D453,801 | S | | 2/2002 | Wimberly | |
| D462,725 | S | | 9/2002 | Wimberly | |

(Continued)

*Primary Examiner*—Vishu K. Mendiratta
(74) *Attorney, Agent, or Firm*—Frederick W. Mau, II

(57) ABSTRACT

A Bingo-type game and method for playing which incorporates various exercises as part of the game. The Bingo-type game generally includes a plurality of matrices having different exercises listed in the squares thereof and call-off pieces each corresponding to one of the exercises listed in the squares. A matrix is given to each game participant. As a call-off card is drawn, the exercise listed on the call-off card is called out, whereby the corresponding exercise is covered, if present, on the matrix of each participant and the exercise is subsequently performed by each participant having the exercise listed on their matrix. The game is won when one of the participants marks each space in a horizontal row, a vertical column, or a diagonal line on the game board.

4 Claims, 2 Drawing Sheets

U.S. PATENT DOCUMENTS 6,582,305 B1 6/2003 Carter
6,585,266 B1 7/2003 Lovell
2004/0242310 A1 12/2004 Perkins

* cited by examiner

FITNESS BINGO

FIELD OF THE INVENTION

The present invention generally relates to a Bingo-type game. More particularly, the present invention relates to a Bingo-type game incorporating exercise as an element of game play.

BACKGROUND

Physical fitness plays an important role in developing and maintaining a healthy body and has gained attention worldwide. Governmental initiatives such as The President's Council on Physical Fitness and Sports, which has been implemented in the United States of America, help to reinforce the role of exercise in one's health. While such programs have increased awareness of the benefits of exercise, other programs and activities are still needed to establish exercise as a part of everyday life.

To incorporate exercise into people's daily lives, it is important to emphasize physical fitness during childhood so that good exercise habits may be developed and maintained as adults. With the advent of video games and television, however, children have become increasingly sedentary. To compound the problem, elementary schools have been moving physical activity out of the classroom setting due to budget cuts, time constraints, and an emphasis on testing. To provide children with some type of exercise during the school day, teachers play games in the classroom that provide entertainment in addition to exercise. Various types of games are routinely utilized for children of all ages. Examples of games incorporating an element of exercise are Duck Duck Goose or Head's Up 7-up, which are played as a reward to children for good behavior. Such games have gained popularity among teachers due to the simplicity with which they can be learned and played, especially in classroom environments. While these games do provide some exercise, the amount and type of exercise is very limited.

Bingo is a popular game that has enjoyed widespread use. Bingo-type games can be played by any number of participants of varying age. Due to the simplicity in which Bingo-type games can be learned and played, many different adaptations of Bingo-type games have been developed for both children and adults. Various adaptations of Bingo-type games have been developed for entertainment and/or educational purposes.

In U.S. Pat. No. 5,957,457, Shaw discloses a Bingo-type game that may be used to facilitate present opening. The game is played with each participant having a matrix with a type of gift randomly listed in each of the matrix squares. As gifts are opened, each participant marks or covers the square corresponding to the opened gift whereby the first person to mark or cover a horizontal row, a vertical column, or a diagonal line wins the game.

Another adaptation of a Bingo-type game is disclosed in U.S. Pat. No. 5,449,179 by Hefferan. Hefferan discloses a holiday Bingo-type game utilizing stickers and candy markers. Each matrix incorporates a motif with a holiday theme. Symbols and or words relating to various holidays are randomly placed in each of the matrix squares. One of a plurality of cards each corresponding to a word or symbol located on any one of the matrices is drawn and called out. Upon the cards being called out, the participants cover or mark the square on their matrix corresponding to the called symbol or word. The first participant to mark or cover a horizontal row, a vertical column, or a diagonal line row wins the game.

In U.S. Pat. No. 5,458,338, Beardsley discloses a Bingo-type game for teaching grammar. The Bingo type game disclosed by Beardsley includes a key card formed with a plurality of rows and columns and calling cards. The rows and columns create a plurality of spaces which include a different word or phrase indicative of a part of speech or a part of the English language. One of a plurality of cards each corresponding to a different word or phrase located in any one of the spaces on the key card is drawn and the word or phrase on the card is called out. Upon the cards being called out, the participants cover or mark the square on the key card corresponding to the called word or phrase. The first participant to mark or cover a horizontal row, a vertical column, or a diagonal line wins the game.

While there are various games that may be played among large groups of people, particularly entire classrooms of children, there still remains a need for other games, especially games incorporating physical fitness as an element of game play. With the simplicity by which Bingo-type games can be learned and played, especially among large groups of people, there is a need for a Bingo-type game that incorporates exercise as an element of game play.

SUMMARY OF THE INVENTION

Disclosed herein, is a Bingo-type game and a method for playing a Bingo-type game. The Bingo-type game incorporates a plurality of exercises as an element of game play.

A first embodiment of a Bingo-type game in accordance with the present invention comprises one or more game boards having a matrix with a plurality of spaces arranged in rows and columns printed on the planar surface thereof, a plurality of different exercise names, whereby one of the plurality of different exercise names is printed in each of the plurality of spaces on the one or more game boards, a plurality of call-off pieces each having one of the plurality of exercise names printed thereon, and marker means for marking the plurality of spaces during game play.

The marker means may comprise one or more marking instruments selected from pens, pencils, ink markers, crayons, and rubber stamps. Alternatively, the marker means may comprise one or more selected from the group consisting of tokens, chips, stickers, buttons, pieces of paper, pieces of cardboard, beans, and pieces of candy. The call-off pieces may comprise one or more selected from cards, balls, chips, and pieces of paper.

The plurality of exercise names may appear only once on each of the game boards. A call-out word may be printed above the first row of the matrix on each of the game boards with each letter of the call-out word being printed above a separate column. The call-out word may be FITGO.

In a second embodiment, the Bingo-type game in accordance with the present invention may comprise one or more game boards having a matrix with a plurality of spaces arranged in rows and columns printed on the planar surface thereof, a plurality of different exercise names, whereby one of the plurality of different exercise names is printed in each of the plurality of spaces except the center space on each of the game boards, the center space of the game board being a free space, a plurality of call-off pieces each having one of the plurality of exercise names printed thereon, and marker means for marking the plurality of spaces during game play.

In accordance with the present invention, there is also provided a method for playing a Bingo-type game with two or more participants comprising the steps of:

1) providing each participant with a game board, each game board having a matrix printed thereon, the matrix having multiple spaces arranged in rows and columns whereby one of a plurality of exercise names is printed in each of the spaces on each game board except the center space, the center space on each game board optionally having a exercise name printed therein;

2) providing a plurality of call-off pieces each having one of the plurality of exercise names printed therein;

3) drawing one of the call-off pieces;

4) calling off the exercise name printed on the drawn call-off piece, whereby each participant marks the called exercise name on the game boards and physically performs the called exercise name upon marking the called exercise name on the game board; and 5) repeating steps 3-4 until a participant marks each of the spaces in a horizontal row, a vertical column, or a diagonal line on the game board.

The method may further comprise the step of:

6) calling out a call-out word upon marking all the spaces in a horizontal row, a vertical column, or a diagonal line.

DETAILED DESCRIPTION OF THE PREFERRED EMBODIMENTS OF THE INVENTION

In accordance with the present invention there is provided a Bingo-type game incorporating a plurality of exercises as an element of game play. The present invention is easy to learn and can be played by people of all ages. Furthermore the present invention can be played by any number of participants, thereby making it ideal for a classroom setting. In a classroom setting, the present invention may be played by children at break-time or during the day as a reward for good behavior. By including various exercises as an element of game play, the present invention provides participants an excellent opportunity to engage in physical activity in an otherwise sedentary environment.

The Bingo-type game in accordance with the present invention generally comprises one or more game boards, a plurality of call-off pieces, and marker means for marking the one or more game boards during game play.

Figure 1:
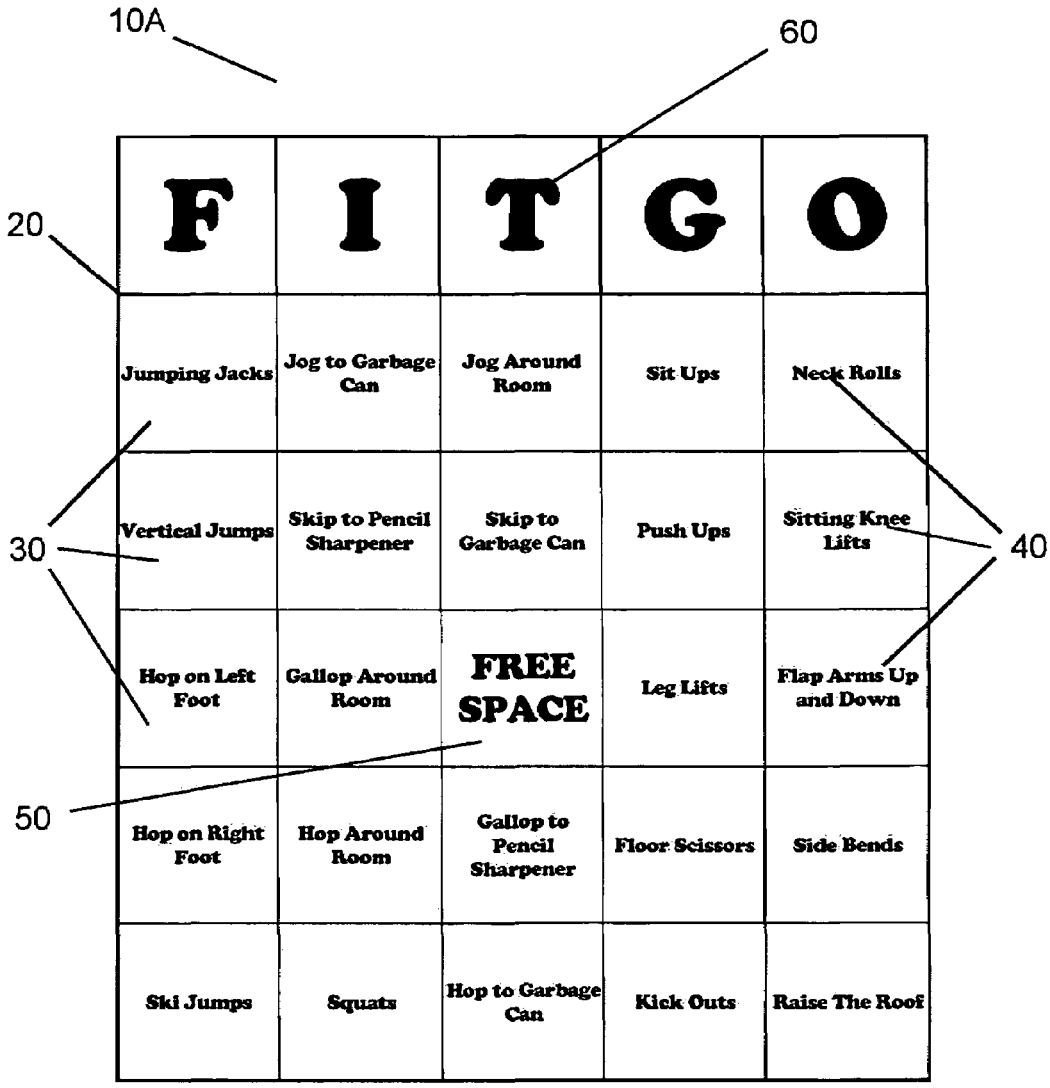
FIG. 1, is a depiction of a first game board in accordance with the present invention.
Figure 2:
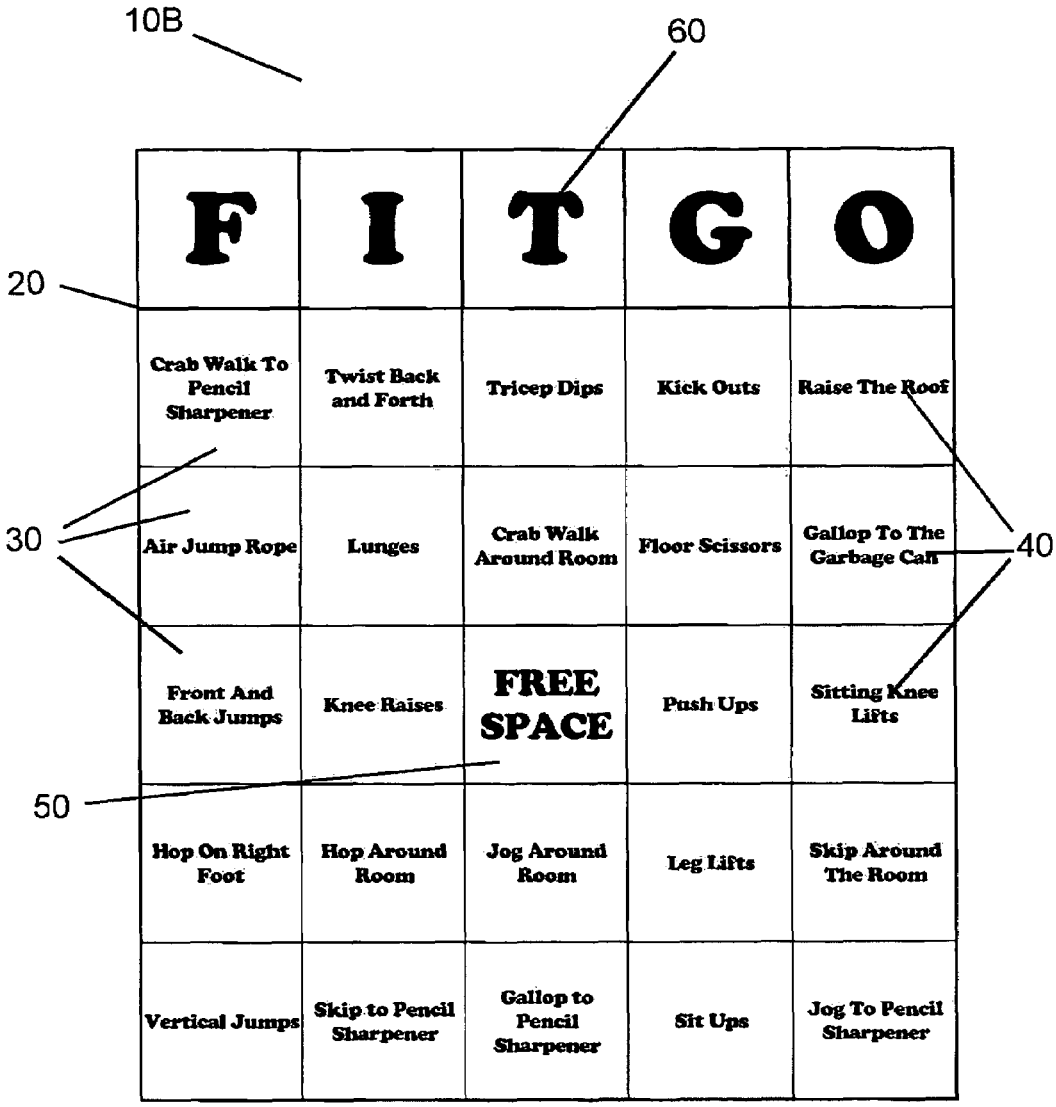
FIG. 2, is a depiction of a second game board in accordance with the present invention.

The one or more game boards are preferably rectangular in shape, however, any type shape may be suitable for the game board design. The one or more game boards may be disposable or reusable. The one or more game boards may be constructed from paper, cardboard, vinyl, plastic, composite, metal, laminate or any other similar type of material. Preferably the one or more game boards are made from a resilient material. The surface of the game boards is preferably cleanable such that the game boards may be cleaned and reused. A first game board 10A in accordance with the present invention is depicted in FIG. 1 and a second game board 10B in accordance with the present invention is shown in FIG. 2. Each of the one or more game boards have a planar surface with a matrix 20 printed thereon. The matrix divides each game board into a plurality of individual spaces 30 arranged in columns and rows. Although the matrix 20 may have any number of rows and columns, the matrix on the game board preferably has five rows and five columns thereby creating twenty five spaces. Where the matrix 20 has more or less than five rows and columns, preferably the game board has an equal number of rows and columns and an odd number of rows and columns.

A different exercise name 40 is printed in each of the spaces 30 on each of the game boards, with the center space optionally having an exercise name printed therein. Each of the game boards has a different arrangement of exercise names 40 in the spaces 30 thereon as shown in the first game board 10A and the second game board 10B. Preferably, exercises 40 do not appear more than once on each game board. The same exercises may also not appear on all of the game boards. The list of various exercises that may be included on in the spaces on the board may include, but are not limited to, jumping jacks, vertical jumps, hop on left foot, hop on right foot, ski jumps, pretend jump rope, crisscross jumps, roman soldiers, crab walk, front and back jumps, jog, skip, gallop, hop around, squats, knee raises, calf raises, lunges, run in place, twist back and forth, tricep dips, arm circles forward, arm circles backward, wall push ups, chair lifts, sit ups, push ups, leg lifts, floor scissors, kick outs, make a bridge, coffee grinders, bike pedals, mountain climbers, raise the roof, windmills, side bends, flap arms up and down, and neck rolls. The names of the exercises listed on the one or more game boards may be in any language.

The center space 50 on the one or more game board may be a "FREE SPACE", whereby an exercise name is not placed in the center space and the center space is used to mark a horizontal row, a vertical column, or a diagonal line. A "FREE SPACE" is a space on the game board that may be marked at the start of the game without having to match a called exercise name. When the center space 50 is a "FREE SPACE," the term "FREE SPACE" may be printed in the center space.

Preferably a call-out word 60 is printed at the top of the matrix 20 with each letter of the call-out word being placed above one of the columns. The first participant to mark each space 30 in a horizontal row, a vertical column, or a diagonal line may call out the call-out word 60 to provide notice to the other participants of the marked horizontal row, vertical column, or diagonal line. The game may also be played such that where two or more participants mark each space in a horizontal row, a vertical column, or a diagonal line at the same time, the first to call out the call-out word is the winner. Where the matrix 20 includes 5 columns, a five letter call-out word may be printed on the top of the matrix with one letter being placed above each column. Preferably, the five letter call-out word is "FITGO," as shows in FIG. 1 and FIG. 2. The names of exercises may be divided into a number of groups equal to the number of columns on the game board matrix 20. The letter of the call-out word at the top of each column may be used to designate which group the exercises are in. Each group contains exercises that will be found only in a specific column. This allows for the exercises to be found quicker by the participants on the game board thus speeding up the pace of game play. For example, where the matrix has 5 columns and "FITGO" is the call-out word, the various exercises will be divided into five groups with each group being designated with F, I, T, G, or O. All of the exercises listed in the group F will only be printed in spaces in the first column under the letter F, all the exercises listed in the group I will be printed in spaces in the second column under the letter I, and so on for letters T, G, and O.

The plurality of call-off pieces may be any type object with an exercise name printed thereon. Each different exercise printed on one or more of the game boards has a corresponding call-off piece with the exercise name printed thereon. When the exercises are divided into groups based on the number of columns as previously described, each call-off piece may also have a letter printed thereon which designates the column on the game board in which the exercise name may be found. The call-off pieces may comprise cards, balls, chips, pieces of paper, or any combination thereof. During game play, the call-off pieces may be placed into a receptacle and individually drawn and called off.

The marker means may comprise any type marking instrument that may be used to mark the game board spaces as they are called off. The marking instrument may be such a pen, pencil, ink marker, crayon, rubber stamp or any other type marking instrument. The marker means may also comprise a plurality of markers such as tokens, chips, stickers, buttons, pieces of paper, pieces of cardboard, beans, pieces of candy, or any other type marker that may be used to cover one of the game board spaces as they are called off.

When playing the Bingo-type game in accordance with the present invention, a game board is first distributed to each of the participants. All of the call-off pieces are then placed in a receptacle or spread out on a surface. The game begins with a caller drawing a call-off piece and calling off the exercise name printed thereon. If the exercises are divided into groups based on the number of columns, the caller will first call off the letter of the call-out word on the call-off piece followed by calling off the exercise name. This allows the participants to look to a specific column of the matrix to find the exercise name thus speeding up game play. After the call-off piece is called off, each participant then marks the space on their game board corresponding to the called-off exercise and performs the called-off exercise. Alternatively, each participant may perform the called-off exercise before marking the space on their game board corresponding to the called-off exercise. If the exercise is not present on a participant's game board, no mark is made on the game board and the participant does not perform the called-off exercise. After the participants are allowed to mark the spaces on their game board, and the exercises are performed by the participants having the called off exercise on their board, the caller draws another call-off piece and the process is repeated. The caller continues to draw call-off pieces and call out the exercises printed thereon until one or more of the participants marks all of the spaces in a horizontal row, a vertical column, or diagonal line on their game board and wins the game. A diagonal line is marked when a participant marks each space in a line from the upper left corner to the lower right corner or from the upper right corner to the lower left corner of the game board. The Bingo-type game may also be played until all of the spaces on the entire board are marked or until a particular design, such as an X or a square including all the outside spaces, is marked on the game board. The caller may require the call-out word to be called off upon completion of a horizontal row, a vertical column, or diagonal line, with the first participant to call out the call-out word being declared the winner.

While the present invention is designed with children in mind, the present invention is not so limited. The various exercises incorporated into the present invention may be selected based on the physical abilities of game participants. As such, the present invention may be played among people of all ages at camps, picnics, family gatherings, nursing homes, and the like.

While there have been described what are believed to be the preferred embodiments of the present invention, those skilled in the art will recognize that other and further changes and modifications may be made thereto without departing from the spirit of the invention, and it is intended to claim all such changes and modifications as fall within the true scope of the invention.

The invention claimed is:

1. A method for playing a Bingo-type game with two or more participants, said method comprising the steps of:

1) providing each participant with a game board, each of said game boards having a matrix printed thereon, the matrix having multiple spaces arranged in rows and columns whereby a physical exercise name is printed in each of said spaces on said game board except the center space, the center space on said game board optionally having a physical exercise name printed therein;

2) providing a plurality of call-off pieces each having a physical exercise name printed thereon, said physical exercise name printed on each of said call-off pieces corresponding to one of said physical exercise names printed on said one or more game boards;

3) drawing one of said call-off pieces;

4) calling off said physical exercise name printed on said drawn call-off piece, whereby each participant marks the called physical exercise name on said game board and physically performs the called physical exercise name upon marking said physical exercise name on said game board; and 5) repeating steps 3-4 until a participant marks each space in a horizontal row, a vertical column, or a diagonal line on said game board.

2. The method according to claim 1, further comprising the step of:

6) calling out a call-out word upon completing a horizontal, Vertical, or diagonal line.

3. The method according to claim 2, wherein said call-out word is FITGO.

4. The method according to claim 1, wherein said center space is a free space.

* * * * *